US005137685A

United States Patent [19]

McDevitt et al.

[11] Patent Number: 5,137,685

[45] Date of Patent: Aug. 11, 1992

[54] MACHINABLE COPPER ALLOYS HAVING REDUCED LEAD CONTENT

[75] Inventors: David D. McDevitt, Greenwood, Ind.; Jacob Crane, Woodbridge, Conn.; John F. Breedis, Trumbull, Conn.; Ronald N. Caron, Branford, Conn.; Frank N. Mandigo, North Branford, Conn.; Joseph Saleh, Branford, Conn.

[73] Assignee: Olin Corporation, New Haven, Conn.

[21] Appl. No.: 662,876

[22] Filed: Mar. 1, 1991

[51] Int. Cl.[5] ..... C22C 9/00

[52] U.S. Cl. ..... 420/477; 148/434; 420/499; 420/500; 420/521

[58] Field of Search ..... 420/477, 499, 500, 521; 148/434

[56] References Cited

U.S. PATENT DOCUMENTS

| | | | |
|---|---|---|---|
| 4,180,398 | 12/1979 | Parikh | 148/11.5 C |
| 4,551,395 | 11/1985 | Lloyd | 428/677 |
| 4,786,469 | 11/1988 | Weber et al. | 420/469 |
| 4,865,805 | 9/1989 | Holowaty | 420/85 |
| 4,879,094 | 11/1989 | Rushton | 420/476 |

FOREIGN PATENT DOCUMENTS

| | | |
|---|---|---|
| 54-135618 | 10/1979 | Japan . |
| 0133357 | 6/1986 | Japan . |

OTHER PUBLICATIONS

Oya et al. Rept. Casting Res. Lab, Waseda Univ., No. 30, 1979, p. 93.

Flemings, Merton C. "Solidification processing" published by McGraw-Hill, Inc 1974 at pp. 252-258.

Plewes, John T. et al., entitled "Free-Cutting Copper Alloys Contain No Lead" appearing in Advanced Materials and Processes, Oct. 1991 at pp. 23-27.

Blazey, Clement, entitled "Brittleness in Copper" appearing in The Journal of the Institute of Metals, at vol. XLVI 1931, at pp. 353-383.

Eborall, entitled "Some Observations of the Mode of Occurrence of Selenium, Tellurium and Bismuth in Copper" appearing in The Journal of the Institute of Metals, at vol. LXX 1944 at pp. 435-446.

Voce et al., entitled "The Mechanism of the Embrittlement of Deoxidized Copper by Bismuth" appearing in The Journal of the Institute of Metals, at vol. LXXIII, 1947 at pp. 323-376.

Schofield et al., entitled "The Microstructure of Wrought Non-Arsenical Phosphorous-Deoxidized Copper Containing Small Quantities of Bismuth" appearing in The Journal of the Institute of Metals, at vol. LXXIII 1947 at pp. 377-384.

Samuels, entitled "The Metallography of Copper Containing Small Amouts of Bismuth" appearing in The Journal of the Institute of Metals at vol. LXXVII, 1949-1950 at pages 91-101.

Chemical Abstracts 91: 95313v (vol. 91) 1979 at p. 95317.

Chemical Abstracts 106: 37311c (vol. 106) 1987 at p. 270.

U.S. Senate Bill 2637 (101st Congress, 2D Session), 1990 at p. 36 entitled "Title IV-Lead Exposure Reduction".

Gordon et al., Science, vol. 223 entitled "Bismuth Bronze from Machu Picchu, Peru" (10 Feb. 1984) at p. 585.

Price et al., "Bismuth-Its Effect on the Hot-Working and Cold-Working Properties of Alpha and Alpha-Beta Brasses" appears in Transactions of A.I.M.E. (1942) on pp. 136-143.

Smith, "Grains, Phases, and Interfaces: An Interpretation of Micro-Structure" appearing in Transactions of A.I.M.E. (1984) at pp. 15-51.

Bishop, "Lead-Free Copper Alloy for Plumbing Developed by AT&T's Bell Laboratories" appearing in The Wall Street Journal, May 15, 1991.

Feder, "A New Form of Brass, to Cut Lead in Drinking Water" appearing in The New York Times, May 15, 1991 at p. D7.

*Primary Examiner*—Upendra Roy

*Attorney, Agent, or Firm*—Gregory S. Rosenblatt; Paul Weinstein

[57] ABSTRACT

Machinable copper alloys having a reduced lead concentration are disclosed. An additive to the alloy accumulates both at the grain boundaries and intragranularly. The additive facilitates chip fracture or lubricates the tool. One additive is a mixture of bismuth and lead with the lead concentration below about 2% by weight.

30 Claims, 1 Drawing Sheet

MACHINABLE COPPER ALLOYS HAVING REDUCED LEAD CONTENT

BACKGROUND OF THE INVENTION

This invention relates generally to machinable copper alloys. More particularly, the invention relates to leaded brass in which at least a portion of the lead is replaced by other elements.

DESCRIPTION OF RELATED ART

Free machining copper alloys contain lead or other additions to facilitate chip formation and the removal of metal in response to mechanical deformation. Mechanical deformation is caused by penetration of a cutting tool. The addition to the alloy is selected to be essentially insoluble in the copper based matrix. As the alloy is cast and processed, the addition collects at both boundaries between crystalline grains and within the grains. The addition improves machinability by two mechanisms. The addition is a stress raiser to encourage chip fracture and also provides lubricity to minimize cutting force and tool wear.

Brass, a copper-zinc alloy, is made more machinable by the addition of lead. One widely used leaded brass is alloy C360 (nominal composition by weight 61.5% copper, 35.5% zinc and 3% lead). The alloy is characterized by high machinability and acceptable corrosion resistance. Alloy C360 is commonly used in environments where exposure to water is likely. Typical applications include potable water transport and distribution such as plumbing fixtures and piping.

The ingestion of lead is harmful to humans, particularly children with developing neural systems. To reduce the risk of exposure to lead, lead has been removed from the pigments of paints. It has now been proposed in the United States Senate to reduce the concentration of lead in plumbing fittings and fixtures to a concentration of less than 2% lead by dry weight. There is, accordingly, a need to develop machinable copper alloys, particularly brasses, which meet the reduced lead target.

One such alloy is disclosed in U.S. Pat. No. 4,879,094 to Rushton. The patent discloses a cast copper alloy which is substantially lead free. The alloy contains from about 1.5–7% by weight bismuth, from about 5–15% zinc, from about 1–12% tin and the balance copper. The alloy is free machining and suitable for use with potable water. However, the alloy must be cast and is not wrought.

A wrought alloy is desirable since the alloy may be extruded or otherwise mechanically formed into shape. It is not necessary to cast objects to a near net shape. Wrought alloy feed stock is more amenable to high speed manufacturing techniques and generally has lower associated fabrication costs than cast alloys.

Another free machining brass is disclosed in Japanese Patent Application 54-135618. The publication discloses a copper alloy having 0.5–1.5% bismuth, 58–65% copper and the balance zinc. The replacement of lead with bismuth at levels up to 1.5% will not provide an alloy having machinability equivalent to that of alloy C360.

SUMMARY OF THE INVENTION

Accordingly, it is object of the invention to provide a lead free or reduced lead copper alloy that is machinable. It is a feature of the invention that in one embodiment, bismuth alloy phases are added to the brass. Yet another feature of the invention is that the bismuth forms a eutectic with other elemental additions. In another embodiment, a spheroidizing agent is added to the alloy. It is another feature of the invention that rather than a bismuth alloy, a sulfide, selenide or telluride particle is formed. It is an advantage of the invention that by proper processing, the sulfides, selenides or tellurides spheroidize rather than form stringers.

As another feature of the invention, calcium aluminates, calcium aluminum silicates and manganese aluminum silicates are formed. It is an advantage of the invention that the calcium and manganese compounds are lubricants which improve machinability by aiding in chip formation. Yet another feature of the invention is that other lubricating compounds may be inserted into the alloy. Among these additions are graphite, talc, molybdenum disulfide and hexagonal boron nitride. It is an advantage of the invention that the lubricating compounds may be inserted into the alloy by spray casting.

Yet another advantage of the invention is that in addition to brasses, the additives of the invention improve the machinability of other copper alloys such as bronzes and beryllium copper.

In accordance with the invention, there is provided a machinable copper alloy. The alloy contains from about 30 to about 58 percent by weight zinc, from an effective amount up to about 5 percent by weight of a bismuth alloy and the balance copper.

The above-stated objects, features and advantages will become more clear from the specification and drawings which follow.

DESCRIPTION OF THE INVENTION

Figure 1:
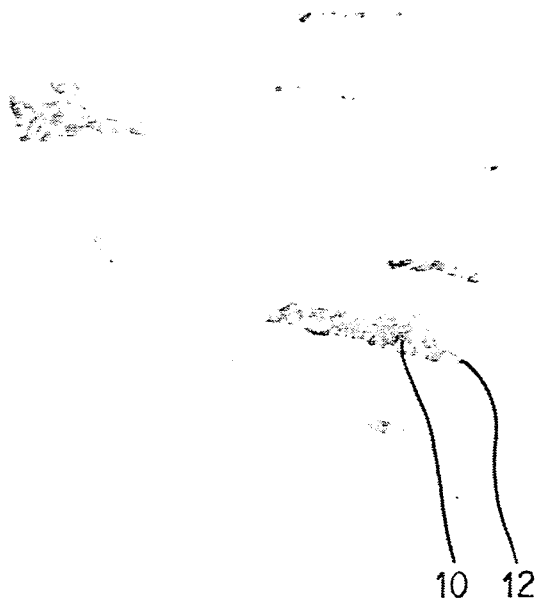
FIG. 1 shows the formation of the bismuth-lead eutectic in a brass containing 1% lead and 2% bismuth.

Brass containing from about 30 to about 58 percent by weight zinc develops a beta phase at high temperatures which enhances hot processing capability. The bismuth alloy disperses uniformly through the alloy. A bismuth alloy will disperse more uniformly than bismuth alone since the alloy is more spheroidal in brass. The additions to the alloy described below will improve the machinability of any brass. For the transportation and distribution of potable water, zinc concentrations towards the lower end of the range are preferred. The corresponding higher concentration of copper inhibits corrosion of the alloy by water. Preferably, the zinc concentration is from about 30 to about 45% zinc and most preferably, from about 32 to about 38% zinc.

A free machining copper alloy is defined as one to which alloying elements have been added to improve machinability. The additions typically either reduce the resistance of the alloy to cutting or improve the useful life of a given tool. Previously, lead has been added to improve machinability. In the context of this invention, a reduced lead copper alloy is one with less lead than conventional copper alloys and preferably with less than 2% by weight lead.

Table 1 shows the effect on machinability of bismuth, lead and bismuth-lead alloys in brass. The brass used to obtain the values of Table 1 contained 36% by weight zinc, the specified concentration of an additive and the balance copper. Machinability was determined by measuring the time for a 0.25 inch diameter drill bit under a load of 30 pounds to penetrate a test sample to a depth of 0.25 inches. The time required for the drill bit to penetrate alloy C353 (nominal composition 62% by weight Cu, 36% Zn and 2% Pb) was given a standard rating of 90 which is consistent with standard machinability indexes for copper alloys. The machinability index value is defined as calculated from the inverse ratio of the drilling times for a fixed depth. That is, the ratio of the drilling time of alloy C353 to that of the subject alloy is set equal to the ratio of the machinability of the subject alloy to the defined machinability value of C353 (90).

$$\text{Machinability}_{(Subject\ Alloy)} = \frac{90 \times \text{Machining Time}_{C353}}{\text{Machining Time}_{(Subject)}} \quad 1$$

TABLE 1

| Addition | Machinability Index |
|---|---|
| 0.5% Pb | 60, 85* |
| 1% Pb | 78, 83 |
| (C353) 2% Pb | 90 (by definition) |
| 3% Pb | 101, 106 |
| 1% Bi | 83, 90 |
| 2% Bi | 93, 97 |
| 1% Pb-0.5% Bi | 85, 88 |
| 1% Pb-1% Bi | 102, 120 |
| 1% Pb-2% Bi | 100, 104 |

*Two samples of each alloy were tested, both calculated values recorded.

As illustrated in Table 1, increasing the bismuth concentration increases machinability. Preferably, the bismuth concentration is maintained below a maximum concentration of about 5 weight percent. This is because above 5% bismuth, processing is inferior and corrosion could become a problem. The minimum acceptable concentration of bismuth is that which is effective to improve the machinability of the copper alloy. More preferably, the bismuth concentration is from about 1.5% to about 3% and, most preferably, the bismuth concentration is from about 1.8% to about 2.2%.

Combinations of lead and bismuth gave an improvement larger than expected for the specified concentration of either lead or bismuth. In a preferred embodiment of the invention, rather than the addition of a single element, combinations of elements are added to brass to improve machinability.

In one embodiment of the invention, the bismuth addition is combined with lead. This is advantageous because leaded brasses with decreased lead content are desirable for potable water. It is not necessary to scrap or refine all high lead content brasses. Higher lead content alloys may be used as feed stock in concert with additions of copper, zinc and bismuth to dilute the lead. When a combination of lead and bismuth is employed, the lead concentration is maintained at less than 2%. Preferably, the bismuth concentration is equal to or greater in weight percent than that of lead. Most preferably, as illustrated in Table 1, the bismuth-to-lead ratio by weight is about 1:1.

FIG. 1 shows a micrograph of the brass sample of Table 1 having a 1%Pb-2%Bi addition. The sample was prepared by standard metallographic techniques. At a magnification of 1000X, the presence of a eutectic phase 10 within the bismuth alloy 12 is visible. The formation of a dual phase particle leads to the development of an entire group of alloy additions which should improve the machinability of brass.

The presence of the PbBi eutectic composition within the grain structure improves machinability. The cutting tool produces a region of elevated temperature at the point of contact with the brass. The PbBi eutectic facilitates the breakup of the alloy through chip fracture.

Table 2 illustrates the eutectic compositions and melting points of bismuth containing alloys which may be formed in copper alloys. It will be noted the melting temperature of several of the eutectics is below the melting temperature of either lead, 327° C., or bismuth, 271° C.

TABLE 2

| Addition | Eutectic Melting Point | Weight % Bismuth |
|---|---|---|
| BiPb | 125° C. | 56.5 |
| BiCd | 144° C. | 60 |
| BiSn | 139° C. | 57 |
| BiIn | 72° C. | 34 |
| BiMg | 551° C. | 58.9 |
| BiTe | 413° C. | 85 |

It is desirable to maximize the concentration of eutectic, so the addition should be added such that the nominal composition of the additive includes at least about 50% of the eutectic phase. More preferably, at least about 90% of the addition is of the eutectic phase. By varying from the eutectic composition in a form such that the lower melting constituent is present in an excess, the machinability is further improved.

In addition to binary eutectics, ternary eutectics and higher alloy systems are also within the scope of the invention.

In addition to a low melting constituent, the presence of a particle which is more discrete and uniformly dispersed throughout the matrix is preferred over a film. A film leads to processing difficulties and a poor machined surface finish. A spheroidizing agent encourages the second phase particle to become more equiaxed. The spheroidizing agent is present in a concentration of from an effective amount up to about 2 weight percent. An effective amount of a spheroidizing agent is that which changes the surface energy or wetting angle of the second phase. Among the preferred spheroidizers are phosphorous, antimony and tin. The spheroidizing agents may be added to either bismuth or any of the eutectic compositions disclosed in Table 2 above. A more preferred concentration is from about 0.1% to about 1%.

In copper alloys other than brasses, such as nickel silvers (for example alloy C725 (nominal composition by weight 88.2% Cu, 9.5% Ni, 2.3% Sn) zinc may be added as a spheroidizing agent. The zinc is present in an effective concentration up to about 25% by weight.

A sulfide, telluride or selenide may be added to the copper matrix to improve machinability. The addition is present in a concentration effective to improve machinability up to about 2%. More preferably, the concentration is from about 0.1% to about 1.0%. To further enhance the formation of sulfides, tellurides and selenides, an element which combines with the three such as zirconium, manganese, magnesium, iron, nickel or mischmetal may be added.

Alternatively, copper oxide particulate in a concentration of up to about 10% by weight may be added to the matrix to improve machinability.

When brass is machined, the tool deteriorates over time due to wear. One method of improving tool life is to provide an addition to the alloy which lubricates the tool minimizing wear. In accordance with this invention, preferred tool coating additions include calcium aluminate, calcium aluminum silicate and magnesium aluminum silicate, graphite, talc, molybdenum disulfide and hexagonal boron nitride. The essentially lead-free additive is preferably present in a concentration of from about 0.05% percent by weight to about 2%. More preferably, the additive is present in a concentration of from about 0.1% to about 1.0%.

Some of the coating elements which improve cutting are not readily cast from the melt. A fine distribution of particles may be achieved by spray casting the desired alloy. A liquid stream of the desired alloy, or more preferably, two streams (one of which may be solid particles), for example, brass as a first stream and calcium silicate as a second stream, are atomized by impingement with a gas. The atomized particles strike a collecting surface while in the semisolid form. The semisolid particles break up on impact with the collecting surface, forming a coherent alloy. The use of two adjacent streams with overlapping cones of atomized particles forms a copper alloys having a second phase component which generally cannot be formed by conventional casting methods.

While the additions for improving machinability have been particularly described in combination with brass, the machinability of other copper based matrices are also improved by the additions of the invention. Among the other matrices improved are copper-tin, copper-beryllium, copper-manganese, copper-zinc-aluminum, copper-zinc-nickel, copper-aluminum-iron, copper-aluminum-silicon, copper-manganese-silicon, copper-zinc-tin and copper-manganese-zinc. In addition, other leaded copper alloys such as C544 (nominal composition by weight 89% copper, 4% lead, 4% tin and 3% zinc) may be formed with a lower lead concentration by the addition of bismuth.

The patent and publication set forth in the application are intended to be incorporated herein by reference.

It is apparent that there has been provided in accordance with this invention, copper alloys having improved free machinability with a reduced lead concentration which fully satisfy the objects, means and advantages set forth hereinbefore. While the invention has been described in combination with specific embodiments and examples thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A reduced lead alloy, consisting essentially of:

from about 30 percent to about 58 percent by weight zinc;

from that amount effective to improve machinability up to about 5% by weight of an addition which includes bismuth and at least one element selected from the group consisting lead, cadmium, tin, indium, magnesium and tellurium; and the balance copper.

2. The reduced lead copper alloy of claim 1 wherein said zinc is present in a concentration of from about 30% to about 45% by weight.

3. The reduced lead copper alloy of claim 2 wherein said zinc is present in a concentration of from about 32% to about 38% by weight.

4. The reduced lead copper alloy of claim 2 wherein said at least one element and said bismuth form a eutectic phase which constitutes at least about 50% of said addition.

5. The reduced lead copper alloy of claim 4 wherein said eutectic phase constitutes at least about 90% of said addition.

6. The reduced lead copper alloy of claim 4 wherein said of bismuth and said at least one element, the addition with a lower melting point is present in excess of the eutectic composition.

7. The reduced lead copper alloy of claim 4 wherein said addition includes lead in a concentration of less than about 2% by weight.

8. The reduced lead copper alloy of claim 4 wherein said addition includes a spheroidizing agent selected from the group consisting of antimony and tin.

9. The reduced lead copper alloy of claim 4 wherein said addition includes at least one element selected from the group consisting of sulphur, tellurium and selenium.

10. The reduced lead copper alloy of claim 7 wherein the concentration of bismuth by weight is greater than that of lead.

11. The reduced lead copper alloy of claim 7 wherein the concentration of bismuth by weight is about equal to that of lead.

12. The reduced lead copper lead alloy of claim 8 wherein said spheroidizing agent is present in a concentration of from that effective to change the wetting angle up to about 2% by weight.

13. The reduced lead copper alloy of claim 9 wherein said addition includes sulfur at a concentration of from that amount effective to improve machinability up to about 2% by weight.

14. The reduced lead copper alloy of claim 13 wherein said sulfur is present in a concentration of from about 0.1% to about 1.0% by weight.

15. The reduced lead copper alloy of claim 13 wherein said addition further includes at least one element from the group consisting of zirconium, manganese, magnesium, iron, nickel and mischmetal.

16. A reduced lead copper alloy consisting essentially of:

from about 30% to about 58% by weight zinc;

from about 1.8% to about 5.0% by weight bismuth; and the balance copper.

17. The reduced lead copper alloy of claim 16 wherein said bismuth is present in a concentration of from about 1.8% to about 3.0% by weight.

18. The reduced lead copper alloy of claim 17 wherein said bismuth is present in a concentration of from about 1.8% to about 2.2% by weight.

19. The reduced lead copper alloy of claim 18 further including up to about 2% by weight of a spheroidizing agent selected from the group consisting of phosphorous, antimony and tin.

20. The reduced lead copper alloy of claim 18 further including up to about 2% by weight of at least one element selected from the group consisting of sulfur, tellurium and selenium.

21. The reduced lead copper alloy of claim 20 wherein said at least one element is sulfur.

22. The reduced lead copper alloy of claim 21 further including at least one element selected from the group consisting of zirconium, manganese, magnesium, iron, nickel and mischmetal.

23. An essentially lead-free copper alloy consisting essentially of:

from about 30% to about 58% by weight zinc;

from about 1.8% to about 5.0% by weight bismuth; and the balance copper.

24. The essentially lead-free copper alloy of claim 23 wherein said bismuth is present in a concentration of from about 1.8% to about 3.0% by weight.

25. The essentially lead-free copper alloy of claim 24 further including up to about 2% by weight of a spheroidizing agent selected from the group consisting of phosphorous, antimony and tin.

26. The essentially lead-free copper alloy of claim 23 further including up to about 2% by weight of at least one element selected from the group consisting of sulfur, tellurium and selenium.

27. The essentially lead-free copper alloy of claim 23 further including at least one element selected from the group consisting of zirconium, manganese, magnesium, iron, nickel and mish metal.

28. The essentially lead-free copper alloy of claim 24 wherein said bismuth is present in a concentration of from about 1.8% to about 2.2% by weight.

29. The essentially lead-free copper alloy of claim 26 wherein said at least one element is sulfur.

30. A reduced lead copper alloy consisting essentially of:

from about 30% to about 58% by weight zinc;

from that amount effective to improve machinability up to about 5% by weight of an addition which includes bismuth and at least one element selected from the group consisting of cadmium, tin, indium, magnesium and tellurium;

up to about 2% by weight of a spheroidizing agent selected from the group consisting of phosphorous, antimony and tin.

* * * * *

US005137685B1

REEXAMINATION CERTIFICATE (2686th)

United States Patent [19]

McDevitt et al.

[11] B1 5,137,685

[45] Certificate Issued Sep. 26, 1995

[54] MACHINABLE COPPER ALLOYS HAVING REDUCED LEAD CONTENT

[75] Inventors: David D. McDevitt, Greenwood, Ind.; Jacob Crane, Woodbridge, Conn.; John F. Breedis, Trumbull, Conn.; Ronald N. Caron, Branford, Conn.; Frank N. Mandigo, North Branford, Conn.; Joseph Saleh, Branford, Conn.

[73] Assignee: Olin Corporation

Reexamination Request
No. 90/003,359, Mar. 14, 1994

Reexamination Certificate for:

| | |
|---|---|
| Patent No.: | **5,137,685** |
| Issued: | **Aug. 11, 1992** |
| Appl. No.: | **662,876** |
| Filed: | **Mar. 1, 1991** |

[51] Int. Cl.[6] ..... C22C 9/00

[52] U.S. Cl. ..... 420/477; 148/434; 420/499; 420/500; 420/521

[58] Field of Search ..... 420/477, 499, 420/500, 521; 148/434

[56] References Cited

U.S. PATENT DOCUMENTS

| | | | |
|---|---|---|---|
| 1,959,509 | 5/1934 | Tour | 75/1 |
| 5,167,726 | 12/1992 | Lolacono et al. | 148/432 |

FOREIGN PATENT DOCUMENTS

| | | |
|---|---|---|
| 0084593 | 9/1955 | Czechoslovakia . |
| 0889984 | 9/1953 | Germany . |
| 61-133357 | 6/1986 | Japan . |

OTHER PUBLICATIONS

Hannesen et al. Z. Metallkde, 58 (1967) 423–433.
The Merck Manual of Diagnosis & Therapy eds. Berkow et al, 16th Ed., 1992, Merck, pp. 2125–2130.
Hummel, R. E. Z. Metallkde, 59 (1968) 153.
Duerrschnabel, W. Z. Metallkde, 59 (1968) 887–894.
Duerrschnabel et al. Z. Metallkde, 59 (1968) 894–900.
Gahr, K. H. Z. Z. Metallkde, 75 (1984) 881–889.
Oya et al Rept. Casting Res. Lab., Waseda Univ., Nr. 30 (1979) p. 93.
Price et al Trans AIME 147 (1942) 136.
Carpenter—"A New Critical Point in Copper–Zinc Alloys: Its Interpretation and Influence on Their Properties", The Journal of the Institute of Metals, No. 1, vol. VII, pp. 127–193 (1912).
Carpenter—"The Effect of Other Metals on the Structure of the beta Constituent in Copper–Zinc Alloys", The Journal of the Institute of Metals, No. 2, vol. VIII, pp. 59–85 (1912).
Johnson, "Influence of Impurities on Muntz Metal", Engineering, p. 283 (Feb. 28, 1913).
Waterhouse, "The Embrittlement of Alpha–Brasses by Liquid Metals", The Journal of the Institute of Metals, vol. 91, pp. 216–219 (1963).
Jackson et al, "A Preliminary Assessment of the Value of Minor Alloy Additions in Counteracting the Harmful Effect of Impurities on the Hot Workability of Some Copper Alloys", The Journal of the Institute of Metals, vol. 98, pp. 193–198 (1970).
Pikunov, "Distribution of Lead and Bismuth in the Structure of Cast Copper and Copper Alloys", Soviet Non–Ferrous Metal Research, vol. 9, No. 2, pp. 154–159 (1981).
Davies, "Bismuth in Copper and Copper Base Alloys" A literature review pepared for the Copper Development Association, pp. 1–52 (1993).

*Primary Examiner*—Upendra Roy

[57] ABSTRACT

Machinable copper alloys having a reduced lead concentration are disclosed. An additive to the alloy accumulates both at the grain boundaries and intragranularly. The additive facilitates chip fracture or lubricates the tool. One additive is a mixture of bismuth and lead with the lead concentration below about 2% by weight.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–22 and 30 are cancelled.

Claim 23 is determined to be patentable as amended.

Claims 24–29, dependent on an amended claim, are determined to be patentable.

23. An essentially lead-free copper alloy consisting essentially of:

from about 30% to about [58%] *45* by weight zinc;

from about 1.8% to about 5.0% by weight bismuth; [and]

the balance copper *wherein the zinc content is sufficient to form an amount of beta phase effective to enhance hot processing capability; and*

*said alloy having been extruded at high temperatures to provide a uniform dispersion of discrete, substantially spheroidal particles and a machinability index similar to or superior to copper alloy C353.*

* * * * *